United States Patent [19]

Bondeson et al.

[11] Patent Number: 4,926,094

[45] Date of Patent: May 15, 1990

[54] HIGH-PERFORMANCE GYROTRON FOR PRODUCTION OF ELECTROMAGNETIC MILLIMETER OR SUBMILLIMETER WAVES

[75] Inventors: Anders Bondeson, Gothenburg, Sweden; Bernhard Isaak, Lausanne; Andre Perrenoud, Nyon, both of Switzerland; Minh Q. Tran, Lausanne, Switzerland

[73] Assignee: Centre for Recherches En Physique Des Plasmas, Lausanne, Switzerland

[21] Appl. No.: 162,510

[22] Filed: Mar. 1, 1988

[30] Foreign Application Priority Data

Mar. 3, 1987 [CH] Switzerland ..... 799/87

[51] Int. Cl.[5] ..... H01J 25/02

[52] U.S. Cl. ..... 315/5; 315/3; 315/4; 372/2

[58] Field of Search ..... 315/3, 4, 5, 5.41, 5.42, 315/5.44; 376/122, 123; 372/2; 333/227; 331/97

[56] References Cited

U.S. PATENT DOCUMENTS

| | | | |
|---|---|---|---|
| 4,491,765 | 1/1985 | Manheimer et al. | 315/4 |
| 4,531,076 | 7/1985 | Holder | 315/5 X |
| 4,553,068 | 12/1985 | Brandt | 315/5 X |
| 4,559,475 | 12/1985 | Manheimer et al. | 315/4 |
| 4,567,402 | 1/1986 | Mourier | 315/5.34 X |
| 4,636,688 | 1/1987 | Ito | 315/5 X |
| 4,661,744 | 4/1987 | Mourier | 315/5 X |

FOREIGN PATENT DOCUMENTS

| | | | |
|---|---|---|---|
| 0003838 | 1/1985 | Japan | 315/5 |
| 0013532 | 1/1986 | Japan | 315/4 |
| 0281702 | 12/1986 | Japan . | |
| 0497893 | 8/1978 | U.S.S.R. | 315/4 |

*Primary Examiner*—Eugene R. LaRoche
*Assistant Examiner*—Seung Ham
*Attorney, Agent, or Firm*—Oblon, Spivak, McClelland, Maier & Neustadt

[57] ABSTRACT

This invention relates to a high-performance gyrotron for the production of electromagnetic millimeter or submillimeter waves with a quasi-optical resonator. The latter is formed by two concave mirrors (1, 2) placed mutually opposite one another on an optical axis. For increasing the decoupling efficiency as well as for reducing the radiation into the environment the quasi-optical resonator is placed in a housing (4), which at least in sections is electrically conductive.

10 Claims, 1 Drawing Sheet

HIGH-PERFORMANCE GYROTRON FOR PRODUCTION OF ELECTROMAGNETIC MILLIMETER OR SUBMILLIMETER WAVES

DESCRIPTION

1. Field of the Invention

The invention relates to a device for the production of electromagnetic millimeter or submillimeter waves of high intensity. It relates especially to a high-performance gyrotron for the production of such waves with a quasi-optical resonator, which is formed by two concave mirrors placed opposite one another in an optical axis. The high-performance gyrotron is provided for use in nuclear fusion for heating of the fusion plasma.

2. Description of the Prior Art

A gyrotron of said type is known, for example, from an article by T.A. Hargeaves et al., Int. J. Electronics 57, 977 (1984) or also from an article by A. Perrenoud et al., Int. J. Electronics 57, 985 (1984).

The resonator, formed by the two concave mirrors, of the known gyrotron is a so-called open resonator. The two concave mirrors, at least in their closer surroundings, are not surrounded by a housing or the like.

In the gyrotron a high-energy electron beam penetrates the resonator along a magnetic field In doing so, the electrons of the electron beam move along the magnetic field on spiral paths with a rotational frequency corresponding to the cyclotron frequency, a rotational frequency which is proportional to the strength of the magnetic field They interact with an electromagnetic alternating field created in the resonator.

The modes excited in the resonator are of the $TEM_{mnp}$ type, in which the signs m and n identify transverse modes and the sign p identifies longitudinal modes (cf. also H. Kogelnik, 1966, Modes in Optical Resonators; Lasers, Vol. 1, published by A.K. Levine, New York: Marcel Dekker, p. 295). In the known gyrotron only the longitudinal $TEM_{oop}$ modes are selected, since they exhibit the smallest diffraction losses.

So that the thermal stress of the concave mirrors in the intended use will not be too great during nuclear fusion (the field power in the resonator can amount to a few megawatts), the mirrors must exhibit a certain minimum size, which is substantially greater (by up to about two orders of magnitude) than the wavelength of the electromagnetic radiation to be produced. The p of the modes excited in the resonator is thus in the range between 40 and 400. As a result the frequency separation between two adjacent modes $TEM_{oop}$ and $TEM_{oo(p+1)}$ is substantially smaller than the instability frequency band of the gyrotron, which raises the problem of a mode competition (cf., e.g., Bondeson et al., Infrared and Millimeter Waves 9, 309 (1984)).

However, in the known gyrotron the open, quasi-optical resonator has been successfully designed so that it is mode-selective, i.e., in it a $TEM_{oop}$ mode is excited by itself or at least in preference to other, adjacent modes $TEM_{oop\pm1}$ (cf. A. Perrenoud et al., Int. Journal of Infrared and Millimeter Waves 7, 427 (1986)) and A. Perrenoud et al., Int. Journal of Infrared and Millimeter Waves 7, 1813 (1086)).

However, especially two disadvantages conflict with the advantage of the attainable mode selectivity of the open resonator structure:

the decoupling efficiency of the resonator is relatively poor because of high radiation losses into the environment;

the high radiation of the resonator interferes with another device installed in its environment;

the device installed in the environment of the resonator can interfere with the operation of the resonator.

SUMMARY OF THE INVENTION

The object of this invention is to indicate a high-performance gyrotron of the initially mentioned type, which is improved relative to its decoupling efficiency, which adversely affects its environment to a lesser extent and whose mode selectivity is still not significantly impaired or is even better.

These and other objects are achieved according to the invention by the data on a new high-performance gyrotron with the features of claim 1.

The advantages of the invention are basically to be seen in that it has been possible to indicate a closed resonator structure, which relative to its mode selectivity is comparable with the known open resonator structure.

The so-called non-Gaussian modes, additionally excited through the housing provided according to the invention, are relatively weak and tolerable in their intensity in comparison with the desired Gaussian $TEM_{oop}$ mode or modes.

By the invention the decoupling efficiency is raised to 100%.

Radiation into the environment is practically completely prevented by the housing provided according to the invention. Other equipment, such as, e.g., deflector coils for the electron beam or a prebuncher can be installed in the immediate vicinity of the resonator.

Advantageous configurations of the invention are characterized in the dependent claims.

BRIEF DESCRIPTION OF THE DRAWINGS

Other features and advantages of this invention can be seen from the following detailed description, especially with reference to the accompanying drawings. There are shown in.

DESCRIPTION OF THE PREFERRED EMBODIMENT

Figure 1:
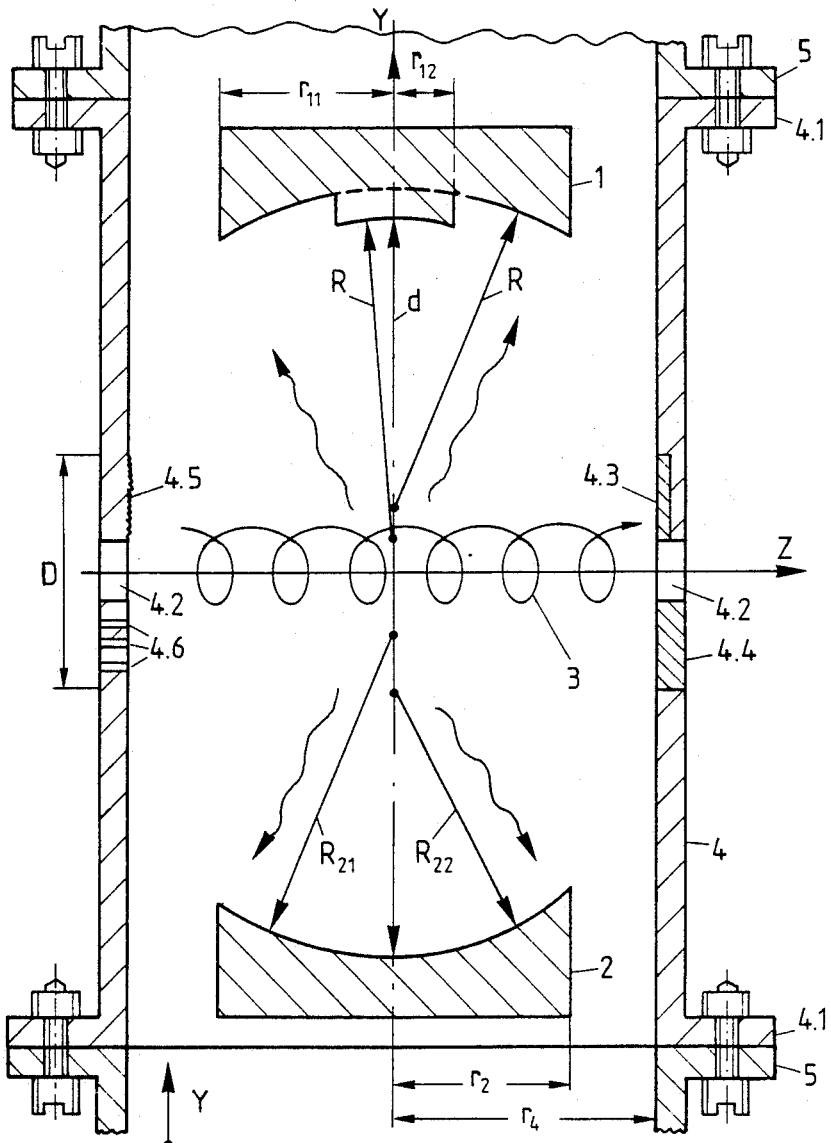
FIG. 1, in sectioned representation the resonator part of a high-performance gyrotron according to the invention placed in a housing, and FIG. 2, in diagrammatic perspective representation an advantageous geometry of the concave mirrors

Reference is now made to the drawing. In FIG. 1, two concave mirrors are identified by 1 and 2, which are placed opposite one another on an optical axis at a distance d. The optical axis in FIG. 1 coincides with a coordinate axis or direction Y. The two concave mirrors 1 and 2 together form a quasi-optical resonator.

A high-energy electron beam 3 in the direction of a coordinate axis Z, perpendicular to direction Y, penetrates into the quasi-optical resonator in the center between the two concave mirrors 1, 2. A largely homogeneous magnetic field, not shown in FIG. 1, is also so aligned between the two concave mirrors 1 and 2. The electrons of electron beam 3 move on spiral paths around the magnetic lines of force. This is indicated by the spiral line in FIG. 1.

The quasi-optical resonator of FIG. 1 is placed in a housing 4. Housing 4 is a cylinder, whose axis coincides with the optical axis of concave mirrors 1, 2. It is, at least predominantly, electrically conductive. The length of the housing extends over a little more than space d between concave mirrors 1, 2. The ratio of the diameter of housing 4 to the diameter of concave mirrors 1, 2 is a parameter depending on the respective use. For a resonator with 2% diffraction losses according to a value of about 1.4 for this ratio to suppress the undesirable non-Gaussian modes The same applies if the electromagnetic field power is decoupled only on one end. Cylindrical housing 4 exhibits connecting flanges 4.1 on its ends. Microwaveguides 5, represented only in section, are flange-mounted on the connecting flanges. The electromagnetic waves, produced in the quasi-optical resonator, are fed to the output of the gyrotron by microwaveguides 5. Further, the housing finally exhibits passage openings 4.2 for electron beam 3.

Radiation of electromagnetic radiation into the environment of the quasi-optical resonator or of the high-performance gyrotron is practically completely prevented by housing 4 and an optimal decoupling efficiency is achieved.

By the selected radius of cylindrical housing 4 and the resulting distance of the housing wall from concave mirrors 1 and 2 the non-Gaussian modes, additionally excited by the presence of housing 4, are tolerably small in comparison with the desirable Gaussian $TEM_{ooo}$ modes.

The desired mode purity can be especially improved by concave mirrors 1, 2 being used with high negative g factors up to $-0.8$. The g factor is defined by $g:=1-d/R$, in which d represents the mutual distance of concave mirrors 1 and 2 and R represents their radius of curvature.

The mode purity can be further improved by selective damping of the undesirable non-Gaussian modes. Calculations show that the strongest of these modes especially in a section in the area of the center between the two concave mirrors 1, 2 are reflected once on the inside wall of housing 4. By design at least of the inside surface of housing 4 in this section in the center between the two concave mirrors 1, 2 the undesirable non-Gaussian modes can be selectively suppressed in a way damping electromagnetic waves, therefore in a simple way.

In FIG. 1 several possibilities are represented of how housing 4 or its inside surface in said section in the center between the two concave mirrors 1, 2 can be designed. However, it is to be understood that only one of the four possibilities represented is actually used in each case. The possibilities are:

To achieve an absorption the inside surface of housing 4 in said section can be provided with a layer 4.3 absorbing electromagnetic waves well. The absorption power of this layer in any case should be substantially greater than the absorption power of the housing wall outside this layer. Alternatively, the entire housing wall can consist of such a material in said section, cf. 4.4.

To achieve a scattering effect the inside surface of housing 4 in said section can be provided with a greater roughness than outside this section, cf. 4.5. The surface can also be serrated, profiled or structured in yet another way.

The housing wall can also be provided in said section with holes or bores 4.6.

The extent D of said specially designed section of housing 4 in direction Y of the optical axis of the two concave mirrors 1, 2 should extend preferably over at most about 1/5 of space (d) between the concave mirrors A decisive improvement of the mode purity can finally be achieved by concave mirrors 1, 2 being used which exhibit a stepped structure, as represented, for example, for concave mirror 1 in FIG. 1. The concave mirrors should exhibit especially two mirror surfaces mutually offset in a steplike manner by one or more whole multiples of the half wavelengths of the desired radiation. The radii of the mutually offset mirror surfaces, identified by $r_{11}$ and $r_{12}$ in FIG. 1, should be designed so that the same energy flow goes to all mirror surfaces.

In addition for improvement of the mode purity, said measures could also serve for an optimizing of other parameters, for example, for a reduction of radius $r_4$ of housing 4.

Figure 2:
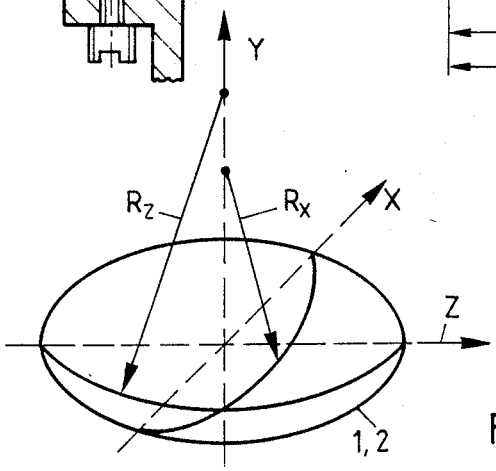

By use of concave mirrors 1, 2 with a geometry deviating from the spherical geometry the electromagnetic efficiency of the gyrotron according to the invention can be improved. Especially, concave mirrors are advantageous which, as represented in FIG. 2 for example, exhibit different radii of curvature $R_X$, $R_Z$ in directions X and Z perpendicular to one another. Direction Z of FIG. 2 is to correspond to the Z direction of FIG. 1.

On the other hand, concave mirrors 1, 2, as represented by concave mirror 2 in FIG. 1 for example, can exhibit different radii of curvature $R_{21}$, $R_{22}$ in two halves in the Z direction.

We claim:

1. High-performance gyrotron for generating electromagnetic millimeter or submillimeter waves, comprising:

a quasi-optical resonator including two concave mirrors placed on an optical axis opposite one another, said optical axis being arranged perpendicular to a direction of a high-energy electron beam, and a cylindrical housing, whose axis coincides with the optical axis, said housing surrounding the quasi-optical resonator and having at least predominantly electrically conducting walls, so that a closed resonator structure is formed and radiation into the environment of the quasi-optical resonator is substantially completely prevented and optical coupling efficiency is achieved.

2. High-performance gyrotron for generating electromagnetic millimeter or submillimeter waves, comprising:

a quasi-optical resonator including two concave mirrors placed on an optical axis opposite one another, said optical axis being arranged perpendicular to a direction of a high-energy electron beam, and a cylindrical housing, whose axis coincides with the optical axis, said housing surrounding the quasi-optical resonator and extending at least over a space between the two mirrors of the quasi-optical resonator and having at least predominantly electrically conducting walls, so that a closed resonator structure is formed and radiation into the environment of the quasi-optical resonator is substantially completely prevented and optical coupling efficiency is achieved.

3. High-performance gyrotron for generating electromagnetic mullimeter or submillimeter waves, comprising:

a quasi-optical resonator including two concave mirrors placed on an optical axis opposite one another, said optical axis being arranged perpendicular to a direction of a high-energy electron beam, and a cylindrical housing, whose axis coincides with the optical axis, said housing surrounding the quasi-optical resonator and having at least predominantly electrically conducting walls;

wherein the housing has a section placed in the center between the two mirrors and extending in the direction of the optical axis, which section is designed in one of the following ways:

an inside surface of said section is provided with at least a layer of a material that absorbs electromagnetic waves more than the walls of the housing outside said section;

an inside surface of said section is profiled in order to achieve a scattering effect either by means of a spherical indentation, whose radius is several times the wavelength of the waves, or by providing a roughness greater than that of the walls of the housing outside said section;

holes are provided in the walls of the housing in said section.

4. High-performance gyrotron accordiing to claim 1, 2 or 3, wherein the millimeter or submillimeter waves are decoupled at a mirror of the quasi-optical resonator and wherein the cylindrical housing has a diameter that is approximately 1.4-times the diameter of said mirror of the quasi-optical resonator.

5. High-performance gyrotron according to claims 1, 2 or 3, wherein a mutual distance d of the mirrors of the quasi-optical resonator and a radius R of curvature of the mirrors are such as to yield a g factor, defined as $g=1, d/R$, of negative values up to $-0.8$.

6. High-performance gyrotron according to claim 3, wherein the cylindrical housing along the optical axis extends at least over a space between the two mirrors of the quasi-optical resonator.

7. High-performance gyrotron according to claim 3, wherein said section extends at most over about 1/5 of the space between the concave mirrors of the quasi-optical resonator.

8. High-performance gyrotron according to claims 1, 2 or 3, wherein, to promote the formation of an individual desired $TEM_{oop}$ mode, each of the two concave mirrors comprises two mirror surfaces, which are mutually offset in a steplike manner by one or more whole multiples of the half wavelength of the desired $TEM_{oop}$ mode, which are placed concentrically to one another and which are designed so that approximately the same energy flow goes to them.

9. High-performance gyrotron according to claims 1, 2 or 3, wherein the concave mirrors exhibit a geometry deviating from a spherical geometry in one or both of the following ways:

each mirror has two different radii of curvature in two directions perpendicular to one another;

each mirror has two halves with two different radii of curvature in the direction of a magnetic field parallel to the high-energy electron beam.

10. High-performance gyrotron according to claims 1, 2 or 3, wherein a microwave guide can be connected to the cylindrical housing at least on one side in the direction of the optical axis.

* * * * *